US011118417B1

(12) United States Patent
AlMalki et al.

(10) Patent No.: US 11,118,417 B1
(45) Date of Patent: Sep. 14, 2021

(54) LOST CIRCULATION BALLOON

(71) Applicant: Saudi Arabian Oil Company, Dhahran (SA)

(72) Inventors: Bandar Salem AlMalki, Dhahran (SA); Ismail A. Adebiyi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/815,519

(22) Filed: Mar. 11, 2020

(51) Int. Cl.

| | |
|---|---|
| ***E21B 21/00*** | (2006.01) |
| ***E21B 27/00*** | (2006.01) |
| ***E21B 33/13*** | (2006.01) |
| ***E21B 34/06*** | (2006.01) |

(52) U.S. Cl.
CPC ..... *E21B 21/003* (2013.01); *E21B 27/00* (2013.01); *E21B 33/13* (2013.01); *E21B 34/06* (2013.01); *E21B 2200/05* (2020.05)

(58) Field of Classification Search
CPC ..... C09K 8/035; C09K 8/08; C09K 8/514; C09K 2208/04; E21B 33/138; E21B 21/003; E21B 33/1277; E21B 33/134
See application file for complete search history.

(56) References Cited

U.S. PATENT DOCUMENTS

| | | | |
|---|---|---|---|
| 2,922,478 | A | 1/1960 | Maly |
| 4,498,995 | A | 2/1985 | Gockel |
| 4,584,327 | A | 4/1986 | Sutton |
| 4,643,255 | A | 2/1987 | Sandiford et al. |
| 4,935,060 | A | 6/1990 | Dingsoyr |
| 5,030,366 | A | 7/1991 | Wilson et al. |
| 5,086,841 | A | 2/1992 | Reid et al. |
| 5,297,633 | A | 3/1994 | Snider et al. |
| 5,325,921 | A | 7/1994 | Johnson et al. |
| 5,402,849 | A | 4/1995 | Jennings, Jr. |

(Continued)

FOREIGN PATENT DOCUMENTS

| | | |
|---|---|---|
| CN | 101 718 183 A | 6/2010 |
| CN | 106 948 789 A | 7/2017 |

(Continued)

OTHER PUBLICATIONS

Datwani, A., Review of Lost Circulation Mechanisms with the Focus on Loss to Natural and Drilling Induced Fractures, Dalhousie University, Halifax, Nova Scotia, 92 pages (Jul. 2012).

(Continued)

*Primary Examiner* — Zakiya W Bates
(74) *Attorney, Agent, or Firm* — Choate, Hall & Stewart, LLP; Charles E. Lyon; Peter A Flynn

(57) ABSTRACT

An example method includes deploying an example system in a vicinity of the lost circulation zone. The example system includes a stop lost-circulation balloon (SLCB) tool. An example SLCB tool includes an inflatable balloon and a tubing string including a fluid conduit. The string is in fluid connection with the balloon. The method includes deploying, from the SLCB tool, the balloon and forcing slurry into the balloon to cause at least part of the balloon containing the slurry into the fracture. The method includes allowing the slurry to set for a period of time to produce a solid. The method includes drilling through the solid in the balloon in the wellbore, leaving the solid in the fracture.

18 Claims, 3 Drawing Sheets

(56) References Cited

U.S. PATENT DOCUMENTS

| | | | |
|---|---|---|---|
| 5,458,194 | A | 10/1995 | Brooks |
| 5,789,352 | A | 8/1998 | Carpenter et al. |
| 6,548,452 | B1 | 4/2003 | Nattier et al. |
| 6,742,592 | B1 | 6/2004 | Le Roy-Delage et al. |
| 6,765,153 | B2 | 7/2004 | Goodson |
| 6,790,812 | B2 | 9/2004 | Halliday et al. |
| 7,219,732 | B2 | 5/2007 | Reddy |
| 7,740,070 | B2 | 6/2010 | Santra et al. |
| 7,964,413 | B2 | 6/2011 | Macioszek et al. |
| 8,820,405 | B2 | 9/2014 | Turner et al. |
| 9,062,241 | B2 | 6/2015 | Zamora et al. |
| 2006/0272819 | A1 | 12/2006 | Santra et al. |
| 2007/0017676 | A1 | 1/2007 | Reddy et al. |
| 2008/0023200 | A1 | 1/2008 | Reddy et al. |
| 2008/0196628 | A1 | 8/2008 | Santra et al. |
| 2009/0178809 | A1 | 7/2009 | Jeffryes et al. |
| 2009/0183875 | A1 | 7/2009 | Rayssiguier et al. |
| 2009/0186781 | A1 | 7/2009 | Zhang |
| 2009/0192052 | A1 | 7/2009 | Zhang |
| 2009/0308611 | A1 | 12/2009 | Santra et al. |
| 2009/0312203 | A1 | 12/2009 | Huang |
| 2010/0252276 | A1 | 10/2010 | Clausen et al. |
| 2013/0068481 | A1* | 3/2013 | Zhou ..... E21B 43/105 166/381 |
| 2014/0305662 | A1 | 10/2014 | Giroux et al. |
| 2015/0267501 | A1 | 9/2015 | Al-Gouhi |
| 2016/0251938 | A1 | 9/2016 | Murray et al. |
| 2019/0249515 | A1 | 8/2019 | al-Shammari |

FOREIGN PATENT DOCUMENTS

| | | | |
|---|---|---|---|
| GB | 2570259 | A | 7/2019 |
| WO | WO-9927032 | A1 | 6/1999 |
| WO | WO-03/042494 | A1 | 5/2003 |
| WO | WO-03/042495 | A1 | 5/2003 |
| WO | WO-2004057150 | A1 | 7/2004 |
| WO | WO-2012143687 | A1 | 10/2012 |
| WO | WO-2014055402 | A1 | 4/2014 |
| WO | WO-2014120458 | A1 | 8/2014 |
| WO | WO-2017034637 | A1 | 3/2017 |
| WO | WO-2018/192042 | A1 | 10/2018 |
| WO | WO-2019/158985 | A1 | 8/2019 |

OTHER PUBLICATIONS

Finger, J. T. and Livesay, B., Alternative Wellbore Lining Methods: Problems and Possibilities, Sand Report, Sandia National Laboratories, 35 pages (printed Aug. 2002).

International Search Report for PCT/IB2018/056517, 5 pages (dated Dec. 13, 2018).

Written Opinion for PCT/IB2018/056517, 8 pages (dated Dec. 13, 2018).

Written Opinion of the International Preliminary Examining Authority for PCT/IB2018/056517, 16 pages (dated Feb. 17, 2020).

International Search Report for PCT/IB2020/055882, 5 pages (dated Oct. 29, 2020).

Written Opinion for PCT/IB2020/055882, 8 pages (dated Oct. 29, 2020).

* cited by examiner

LOST CIRCULATION BALLOON

TECHNICAL FIELD

This specification relates generally to example processes for curing a lost circulation zone in a wellbore.

BACKGROUND

In a well, such as an oil well, a lost circulation zone is a region in a subterranean formation that inhibits, or prevents, return of mud or other materials following introduction of drilling fluid. For example, during creation and completion of a well, drilling fluid is introduced into the wellbore. Then, mud and other materials from the wellbore flow back to the surface of the well. However, in a lost circulation zone, the introduction of drilling fluid into the wellbore does not produce a corresponding flow back to the surface of the well.

There can be various causes for lost circulation zones. In some cases, the formation may be highly permeable and have a less-than-normal hydrostatic pressure. In some cases, the formation may contain faults, such as fractures, into which the drilling fluid escapes, thereby interrupting the circulation of fluids into, and out of, the wellbore. Such faults in the formation can also adversely affect cementing operations performed to complete the well. For example, fluids in the formation can prevent, or prolong, hardening of cement slurry. This may be due, at least in part, to mixing of the fluids with the cement slurry. For example, this mixing of fluids may prevent the slurry from ever setting enough to harden.

In some situations, lost circulation material (LCM) pills, cement plugs, and X-linked polymer plugs have been injected into a lost circulation zone in a well in attempts to cure the lost circulation zones.

SUMMARY

An example method for curing a wellbore includes treating a lost circulation zone in the wellbore. The method includes identifying a lost circulation zone in a wellbore. The lost circulation zone includes a fracture in a formation adjacent to the wellbore. The method includes deploying an example system in a vicinity of the lost circulation zone. The example system includes a stop lost-circulation balloon (SLCB) tool. An example SLCB tool includes an inflatable balloon and a tubing string including a fluid conduit. The string is in fluid connection with the balloon. The method includes deploying, from the SLCB tool, the balloon and forcing slurry into the balloon to cause at least part of the balloon containing the slurry into the fracture. The method includes allowing the slurry to set for a period of time to produce a solid. The method includes drilling through the solid in the balloon in the wellbore, leaving the solid in the fracture.

An example SLCB tool may include a multiport sub. The multiport sub may be in fluid communication with the string at an uphole end of the multiport sub and in fluid communication with the balloon at a downhole end of the multiport sub. The multiport sub may include one or more ports in a wall of the multiport sub to allow wellbore fluid to enter the multiport sub.

An example SLCB tool may include a balloon holder for at least partially housing and releasably retaining at least a part of the balloon.

An example SLCB tool may include a flapper valve disposed between the multiport sub and the balloon to prevent wellbore fluids from entering the balloon when the flapper valve is shut.

An example SLCB tool may be releasably connected at an uphole end of the SLCB tool to a release sub at a downhole end of the string.

The example method may include deploying a shut-off dart. The shut-off dart may include a shut-off plug for sealing off one or more ports in a multiport sub. The shut-off dart may include a tube disposed within the shut-off dart establishing a fluid connection between an uphole end and a downhole end of the shut-off dart. Deploying the shut-off dart may include causing a balloon holder to at least partially release the balloon from the holder, thereby deploying the balloon. Releasing the balloon may include shearing, by the shut-off dart, one or more balloon holding pins. Deploying the shut-off dart may include sealing off one or more ports in the multiport sub, opening a flapper valve disposed between the multiport sub and the balloon, and establishing a fluid connection between the fluid conduit of the string, the tube, and the balloon.

An example method may include deploying, after forcing slurry into the balloon, a releasing plug. Deploying the releasing plug may cause the SLCB tool to be released from the string. Releasing the SLCB tool may include shearing, by the releasing plug, one or more SLCB holding pins.

An example method may include, after forcing slurry into the balloon, retracting the string uphole while the SLCB tool remains in position in the wellbore.

An example system is configured to operate within a lost circulation zone in a wellbore. An example system includes a tubing string include as a fluid conduit and a release sub. An example system includes a stop lost-circulation balloon (SLCB) tool releasably connected to the release sub. An SLCB tool includes an inflatable balloon in fluid connection with the string and a balloon holder at least partially housing and releasably retaining at least a part of the balloon. An SLCB tool includes a multiport sub in fluid communication with the string at an uphole end of the multiport sub and in fluid communication with the balloon at a downhole end of the multiport sub.

An example system may include a flapper valve disposed between the multiport sub and the balloon to prevent wellbore fluids from entering the balloon when the flapper valve is shut. The multiport sub may be connected to the releasing sub via one or more SLCB holding pins. The balloon may be at least partially retained by the balloon holder via one or more balloon holding pins.

An example system may include a shut-off dart including a shut-off plug for sealing off one or more ports in a multiport sub. A shut-off dart may include a tube disposed within the shut-off dart establishing a fluid connection between an uphole end and a downhole end of the shut-off dart. The shut-off dart may be configured to shear one or more balloon holding pins thereby releasing the balloon.

An example system may include a releasing plug for shearing one or more SLCB holding pins and releasing the SLCB tool from the string.

Any two or more of the features described in this specification, including in this summary section, may be combined to form implementations not specifically described in this specification.

All or part of the processes, methods, systems, and techniques described in this specification may be controlled by executing, on one or more processing devices, instructions that are stored on one or more non-transitory machine-readable storage media. Examples of non-transitory machine-readable storage media include read-only memory, an optical disk drive, memory disk drive, random access memory, and the like. All or part of the processes, methods, systems, and techniques described in this specification may be controlled using a computing system comprised of one or more processing devices and memory storing instructions that are executable by the one or more processing devices to perform various control operations.

The details of one or more implementations are set forth in the accompanying drawings and the description subsequently. Other features and advantages will be apparent from the description and drawings, and from the claims.

DETAILED DESCRIPTION

Figure 2:
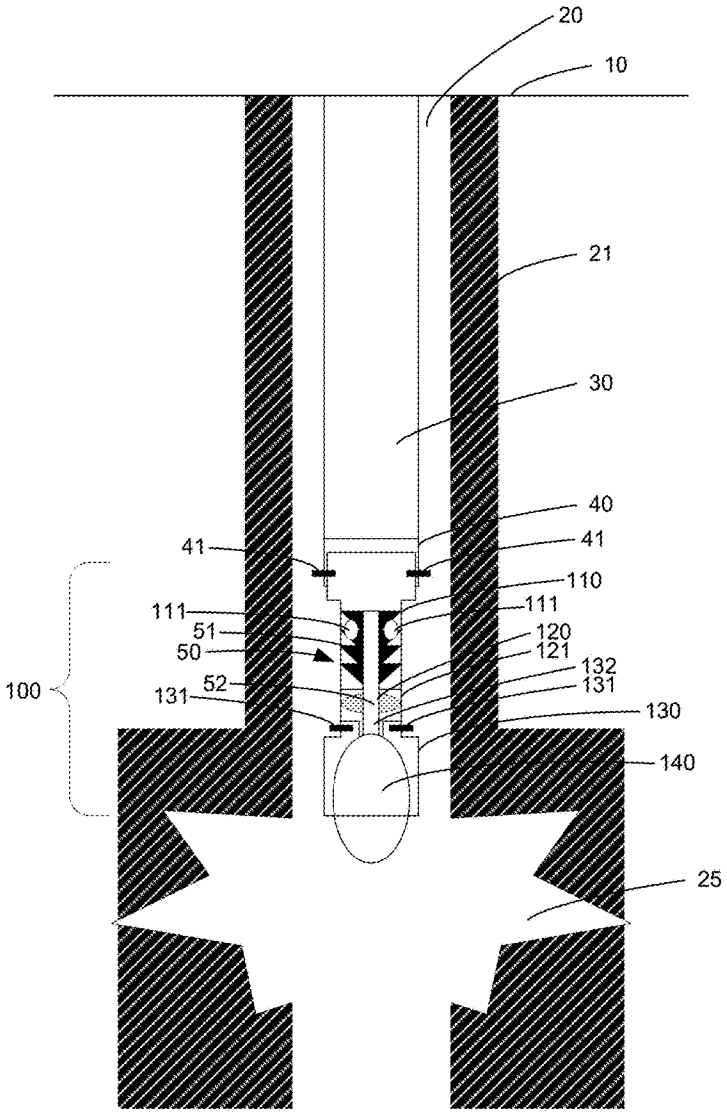
FIG. 2 is a cross-section of an example wellbore and an example system for curing a lost circulation zone as described in this specification with a shut-off dart in its final deployed position.

Described in this specification are example technologies, devices, and processes for curing a lost circulation zone in a wellbore. The example processes include detecting a lost circulation zone in a wellbore. A lost circulation zone may include a part of the wellbore that traverses a rock formation containing faults, such as fractures, into which drilling fluid escapes, thereby interrupting the circulation of fluids into, and out of, the wellbore. An inflatable device, such as a balloon, is arranged in the vicinity of the lost circulation zone. For example, the inflatable device may be arranged within or uphole of the lost circulation zone. The inflatable device may be connected to a joint or other appropriate structure in a conduit introduced into the wellbore. Slurry, such as cement slurry, is forced into the inflatable device to cause its expansion. As the inflatable device expands, one or more parts of the inflatable device containing the slurry expand into fractures in the formation. In some implementations, the inflatable device may be configured and arranged to enable expansion throughout the lost circulation zone. As a result, all or some faults in the lost circulation zone are wholly or partly filled with slurry contained within the inflatable device. The slurry is then set for a period of time to produce a solid, such as cement, which may be present both in the wellbore and in the formation fractures. A drill may then cut through the solid in the wellbore, leaving the solid in the fractures. The solid thus fills the fractures, thereby curing the lost circulation zone.

Generally, to produce a well, a drill bores through earth, rock, and other materials to form a wellbore. In some implementations, a casing may support the sides of the wellbore. The drilling process includes, among other things, pumping drilling fluid down into the wellbore, and receiving return fluid containing materials from the wellbore at surface. In some implementations, the drilling fluid includes water- or oil-based mud and, in some implementations, the return fluid contains mud, rock, and other materials to be evacuated from the wellbore. This circulation of fluid into, and out of, the wellbore, may occur throughout the drilling process. In some cases, this circulation is interrupted, which can have an adverse impact on drilling operations. For example, loss of circulation can result in dry drilling, which can damage the drill bit, the drill string, or the drilling rig itself. In some cases, loss of circulation can cause a blow-out and result in loss of life.

There are degrees of lost circulation that may be addressed. For example, a total loss of circulation occurs when no return fluid reaches the surface following introduction of drilling fluid into the wellbore. A total loss of circulation may result from faults, such as fractures, in a subterranean formation. For example, the drilling fluid, the return fluid, or both may escape into fractures in a surrounding formation, causing the loss of circulation. Depending upon the size of the fracture and the volume of fluids involved, the escaping fluids may cause a total loss in circulation or a partial loss in circulation. In this regard, a partial loss of circulation results in less return fluid than anticipated for a given amount of drilling fluid. A partial loss of circulation may also be caused by subterranean formations that are highly permeable, that have a less-than-normal hydrostatic pressure, or both. In some cases, drilling with total loss of circulation may result in hole collapse due lack of hydrostatic pressure supporting the wellbore. This can lead to drilling equipment being lost or stuck downhole.

In some implementations, a lost circulation zone may be identified based on the volume of return fluid removed from a wellbore. For example, the volume of return fluid may be measured using one or more detection mechanisms, and compared to an expected volume of return fluid for a given amount of drilling fluid pumped into the wellbore. If the amount of return fluid deviates by more than a threshold amount from the expected amount of return fluid for a given depth in a wellbore, a lost circulation zone is detected. In some implementations, computer programs may be used to process information about the volumes of drilling fluid and return fluid, and to make a determination about whether a lost circulation zone has been encountered. In some implementations, this determination may be made in real-time (such as during drilling) so that the situation can be remedied before damage occurs. In some implementations, the computer programs may be used to alert drilling engineers about a detected lost circulation zone, to begin automatic remedies, or both. In some implementations, a lost circulation zone may be detected using other methods based on the quantity or quality of the return fluid.

In some implementations, lost circulation zones may affect cementing operations. In this regard, drilling cuts through rock formations to form a wellbore that reaches a subterranean reservoir. The sides of the wellbore, however, typically require support. A casing is inserted into the wellbore and is used for supporting the sides of the wellbore, among other things. In some implementations, the casing—also called a setting pipe—may be a metal tubing that is inserted into the wellbore in sections. A space between the casing and the untreated sides of the wellbore may be cemented to hold the casing in place.

During normal cementing operations—for example, cementing operations solely to support a casing in a wellbore—cement slurry is pumped into the wellbore and allowed to set to hold the casing in place. The cement slurry may occupy a space between the wellbore and the casing, and may harden there to form cement. After the cement has hardened at least a threshold amount, the bottom of the well may be drilled, and the process for completing the well proceeds. In lost circulation zones, such as those involving fractures, the cement slurry may also escape into the fracture, may mix with formation fluid in the fracture, or both. This may prevent the cement from hardening, and thus supporting the casing. Accordingly, a lost circulation zone may also affect cementing operations.

Figure 1:
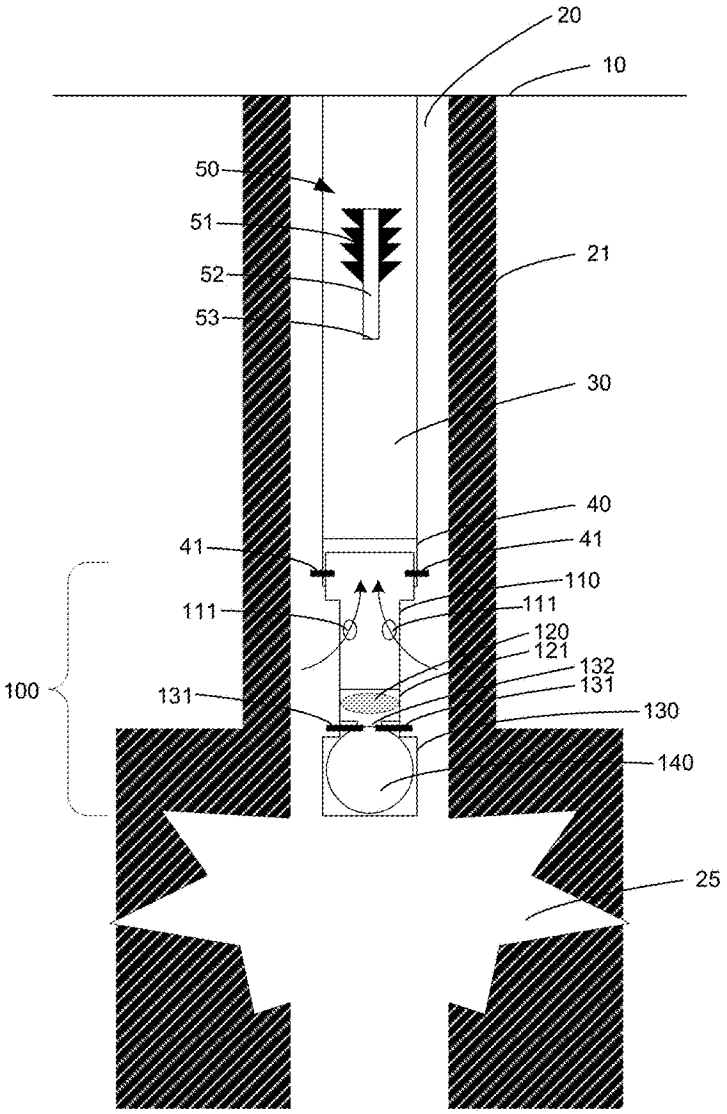
FIG. 1 is a cross-section of an example wellbore and an example system for curing a lost circulation zone as described in this specification with a shut-off dart during deployment.

FIG. 1 illustrates an example technology for curing a lost circulation zone. In an example, a wellbore 20 in rock formation 21 extends downward from a surface 10. Wellbore 20 may be lined with a casing or liner (not shown). Wellbore 20 may include a lost circulation zone 25 in rock formation 21. In some implementations, a system or tool as described in this specification may be deployed to cure the lost circulation zone 25. An example system may include a string 30, for example, a drill string or tool string. String 30 may be or may include tubing, for example, coiled tubing, for example, for conveying one or more fluids. An example string 30 may include or may be connected to a release sub 40 to releasably connect one or more tools to a downhole (distal) end of a string 30. A release sub 40 may have a substantially tubular structure and may include one or more fluid seals, for example, to prevent wellbore fluids from entering string 30 through the connection between release sub 40 and one or more tools connected to release sub 40.

An example system may include a stop lost-circulation balloon (SLCB) tool 100. In some implementations, SLCB tool 100 may be connected to a string 30. In some implementations, an uphole end of SLCB tool 100 may be releasably connected to a release sub 40. In some implementations, an SLCB tool 100 may be releasably connected to a release sub 40 through a mechanism including one or more SLCB tool holding pins 41. An example SLCB tool holding pin 41 may be configured or arranged such that mechanically shearing or otherwise breaking one or more SLCB tool holding pins 41 disrupts the connection between SLCB tool 100 and release sub 40, thereby disconnecting SLCB tool 100 and release sub 40.

In some implementations, SLCB tool 100 includes a multiport sub 110. In some implementations, multiport sub 110 may have a substantially tubular structure and may be connected to a string 30 or connected to release sub 40. A multiport sub 110 may be in fluid communication with string 30, for example, at an uphole (proximal) end of multiport sub 110. In some implementations, a multiport sub 110 may be in fluid communication with string 30, for example, via a release sub 40 at a downhole end of string 30. A multiport sub 110 may be in fluid communication with a balloon 140 or a balloon holder 130, or both, for example, at a downhole (distal) end of multiport sub 110. A multiport sub 110 may include one or more ports 111 in a wall of the multiport sub to allow wellbore fluids to enter the multiport sub 110 and string 30, as illustrated by the arrows in FIG. 1. This may allow an operator to monitor or maintain control (or both) over fluid conditions downhole. For example, undesired influx of hyrdocarbons may be managed by allowing the hydrocarbons to circulate out of the well through string 30.

In some implementations, SLCB tool 100 may include a valve, for example, a flapper valve 120 held in a valve housing 121 at or near a downhole (distal) end of multiport sub 110. In some implementations, a valve, for example, flapper valve 120 may insulate an inflatable device, for example, a balloon 140 or a balloon holder 130, or both, from wellbore fluids entering the multiport sub 110 when flapper valve 120 is closed. In some implementations, a flapper valve 120 may include one or more substantially flat elements having an uphole (proximal) side and a downhole (distal) side. In some implementations, the flat elements may be configured or arranged (of both) such that they remain closed when fluid pressure is applied from an uphole side, for example, when pressure is applied substantially to the entire surface area of an uphole side of a flat element. The flat elements may be configured or arranged such that they open when a force or pressure is applied to only a fraction of the surface are of an uphole side (for example, less than half the surface area), for example, causing one or more flat elements to pivot.

SLCB tool 100 includes an inflatable device, for example, a balloon 140 that may be in fluid communication to valve housing 121, multiport sub 110, and string 30. In some implementations, balloon 140 is at least partially housed by a balloon holder 130 that may be positioned at a downhole (distal) end of multiport sub 110 or valve housing 121. In some implementations, balloon 140 may be in a deflated or folded (or both) configuration while SLCB tool 100 is being transferred downhole. In some implementations, a portion of a balloon 140 may be releasably retained within balloon holder 130 at least in part through a mechanism including one or more balloon holding pins 131. An example balloon holding pin 131 may be configured or arranged such that mechanically shearing or otherwise breaking one or more balloon holding pins 131 disrupts a mechanical connection between balloon 140 and balloon holder 130, thereby at least partially releasing the balloon 140 from balloon holder 130. After at least partial release of balloon 140 from balloon holder 130, balloon 140 may remain in connected to one or more components of SLCB tool 100, for example, multiport sub 100, such that fluid communication with string 30 is maintained.

The size of the balloon, and therefore the amount of expansion the balloon can tolerate, may be based on the subterranean geography of the lost circulation zone. For example, a lost circulation zone having large fractures may require a larger balloon than a lost circulation zone having smaller fractures. The geography of the lost circulation zone may be mapped prior to inserting the balloon into the lost circulation zone. The size, composition, and other attributes of the balloon may be selected based on downhole features, such as the depth of the lost circulation zone, the sizes and numbers of fractures contained in the lost circulation zone, and the diameter of the wellbore. The size, composition, and other attributes of the balloon may also be selected based on downhole environmental conditions, such as temperature and pressure.

Still referring to FIG. 1, in an example procedure, a string 30 and an SLCB tool 100 may be deployed downhole near a lost circulation zone, for example, at or near an uphole (proximal) end of a lost circulation zone 25. One or more ports 111 are open allowing wellbore fluid to enter multiport sub 110 and string 30. Example balloon 140 is substantially retracted into balloon holder 130. A shut-off dart 50 is then deployed inside string 30 and moved downhole, for example, through gravity or by deploying shut-off dart 50 in a fluid pumped downhole. An example shut-off dart 50 may include one or more shut-off plugs 51, and a tube 52, the one or more shut-off plugs 51 and tube 52 having a lumen disposed along a longitudinal axis of shut-off dart 50 (for example, an axis substantially parallel to string 30). In some implementations, a tube 52 may be sealed at a downhole (distal) end of the tube, for example, with a membrane 53.

FIG. 2 shows the system with shut-off dart 50 in its final deployed position. In some implementations, when fully deployed, shut-off dart 50 enters and at least partially traverses multiport sub 110. In some implementations, shut-off plug 51 seals off one or more ports 111 or a proximal end of multiport sub 110, or both. This may stop wellbore fluid from entering multiport sub 110 or string 30, or both. After the one or more ports are sealed off, wellbore fluid present in string 30 may be removed, for example, pumped out. In some implementations, tube 52 opens and traverses flapper valve 120. In some implementations, downhole (distal) movement of tube 52 during deployment may cause one or more balloon holding pins 131 to shear, thus releasing some or all of balloon 140. Balloon 140 remains in fluid communication with multiport sub 110 or string 30, or both. For example, balloon 140 may be connected to a collar 132 that may be, for example, part of balloon holder 130 or flapper valve housing 121 and may be in fluid communication with multiport sub 110 and string 30. In some implementations, a downhole (distal) end of tube 52 forms a fluid connection with collar 132. In some implementations, a downhole (distal) end of tube 52 is inserted into collar 132, forming a fluid seal and a fluid connection with balloon 140. An uphole (proximal) end of tube 52 may be open and in fluid communication with, for example, string 30.

Figure 3:
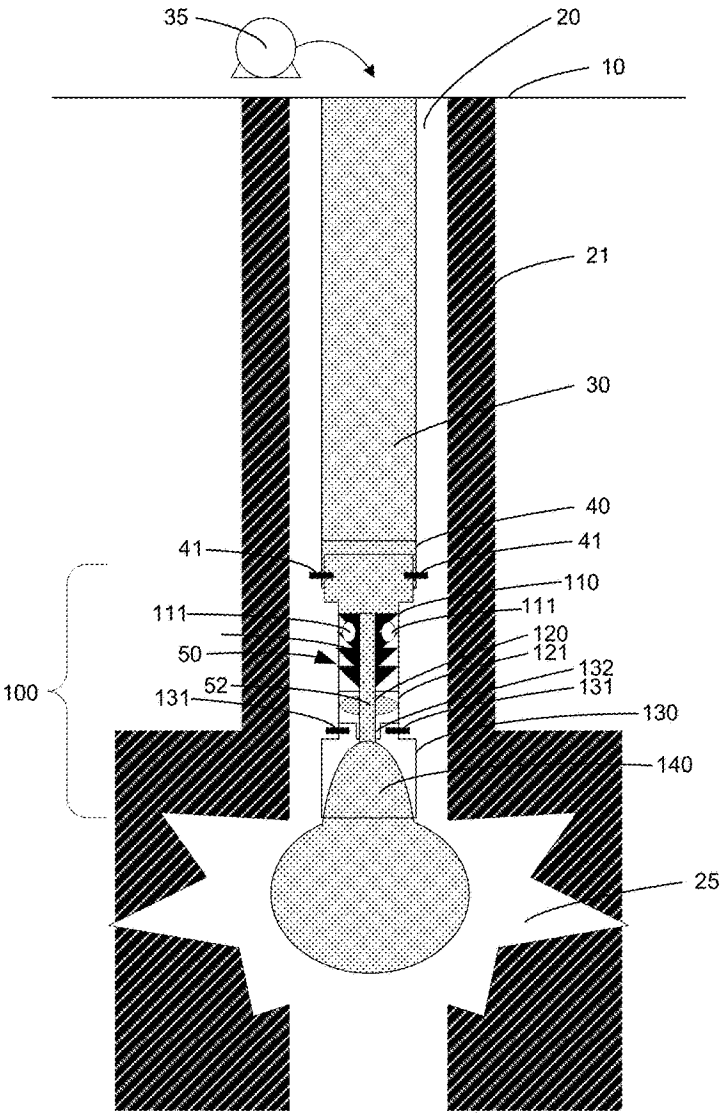
FIG. 3 is a cross-section of an example wellbore and an example system for curing a lost circulation zone as described in this specification during balloon filing.

Referring to FIG. 3, once a shut-off dart 50 is fully deployed and balloon 140 is at least partially released from balloon holder 130, a balloon filling procedure may begin. In some implementations, a pump, for example, uphole pump 35, begins pumping slurry, for example, cement slurry 36 down a conduit, for example, lumen of string 30 or another conduit in fluid connection with the lumen of shut-off dart 50. Examples of other conduits that may be used for this purpose include, but are not limited to, a drill pipe and a fiberglass pipe. In some implementations, cement slurry 36 enters a lumen of tube 52. Forcing cement slurry 36 through tube 52 may cause membrane 53 at the downhole (distal) end of tube 52 to rupture. As downhole (distal) end of tube 52 forms a fluid connection with collar 132 or balloon 140, rupturing membrane 53 may create a fluid conduit between balloon 140 and, for example, string 30. Cement slurry 36 may be forced (for example, pumped) through string 30 and tube 52 into balloon 140. Balloon 140 may expand and fill, at least in part, lost circulation zone 25.

Figure 4:
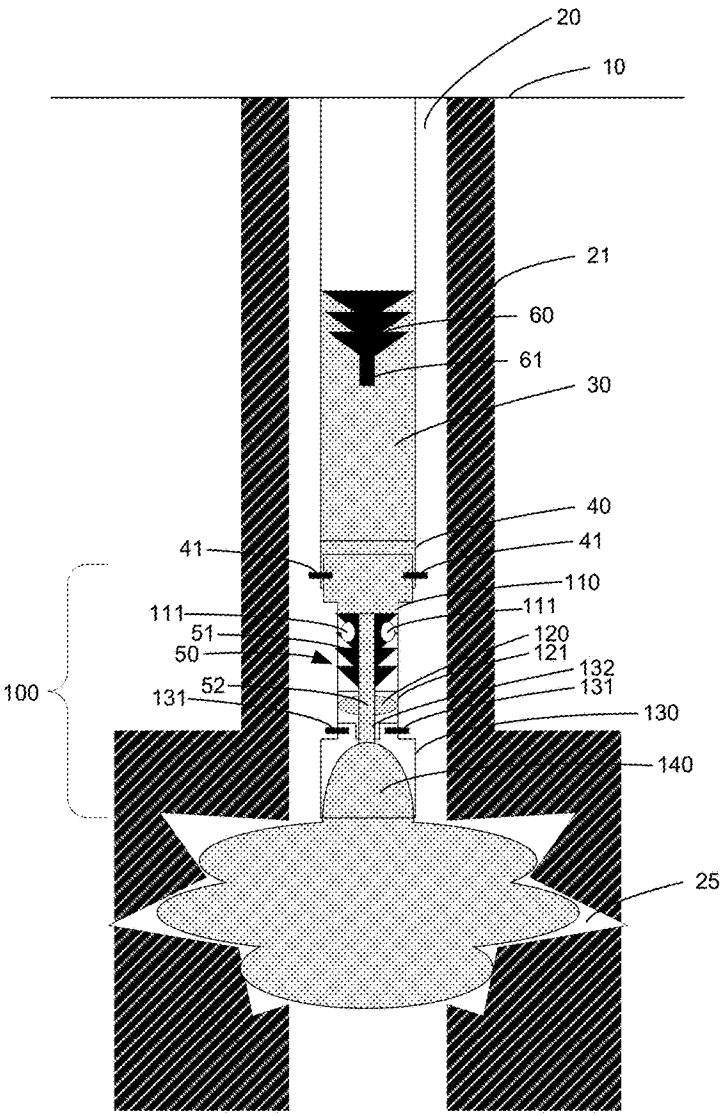
FIG. 4 is a cross-section of an example wellbore and an example system for curing a lost circulation zone as described in this specification with a release plug during deployment.

Referring to FIG. 4, at or near completion of slurry pumping operations, a balloon 140 may be fully or substantially fully expanded and may fill a lost circulation zone 25, for example, such that fluid flow into or out of wellbore 20 may be prevented or impeded. At or near completion of slurry pumping operations, a releasing plug 60 may be deployed, for example, in a lumen of string 30. In some implementations, downhole (distal) movement of releasing plug 60 may be aided by pumping fluid down string 30. In some implementations, releasing plug 60 includes a tube plug 61

Figure 5:
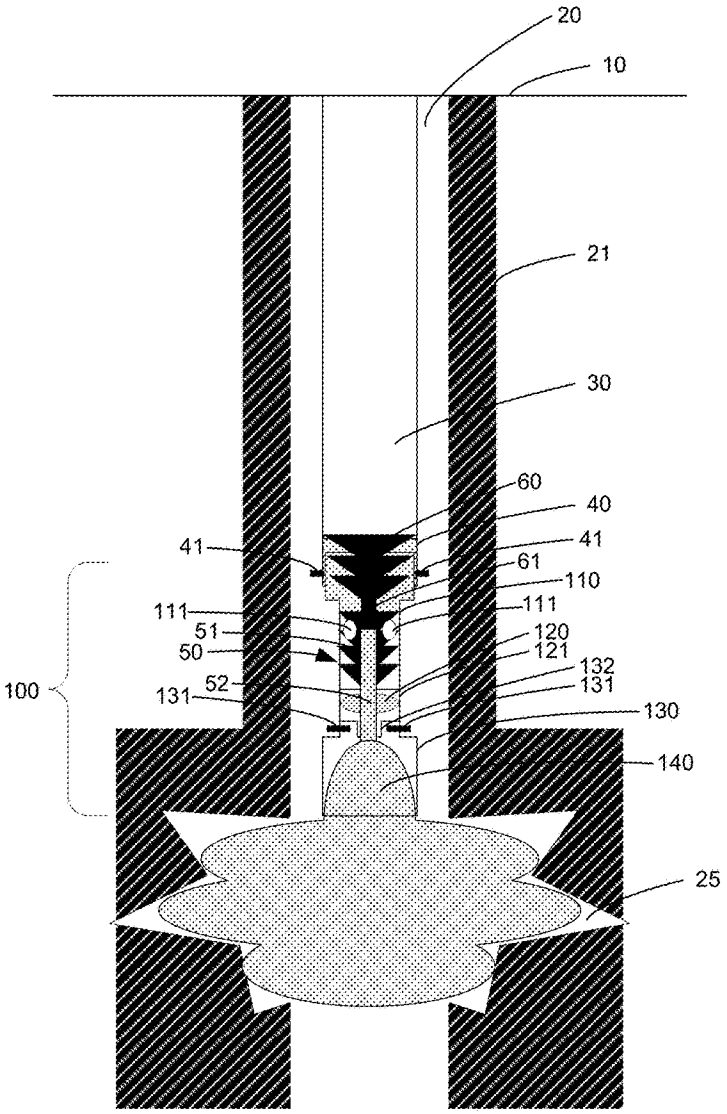
FIG. 5 is a cross-section of an example wellbore and an example system for curing a lost circulation zone as described in this specification with a release plug in its final deployed position.

FIG. 5 shows the system with releasing plug 60 in its final deployed position. In some implementations, releasing plug 60 enters and at least partially traverses multiport sub 110. In some implementations, downhole (distal) movement of releasing plug 60 during deployment may cause one or more SLCB holding pins 41 to shear, thus releasing SLCB tool 100 from releasing sub 40. In some implementations, releasing plug 60 may be configured such that when the releasing plug 60 is in its final deployed position in multiport sub 110, releasing plug 60 creates a fluid seal between string 30 and balloon 140. In some implementations, tube plug 61 may enter a lumen of tube 52 of shut-off dart 50, thereby creating a fluid seal between string 30 and balloon 140.

Figure 6:
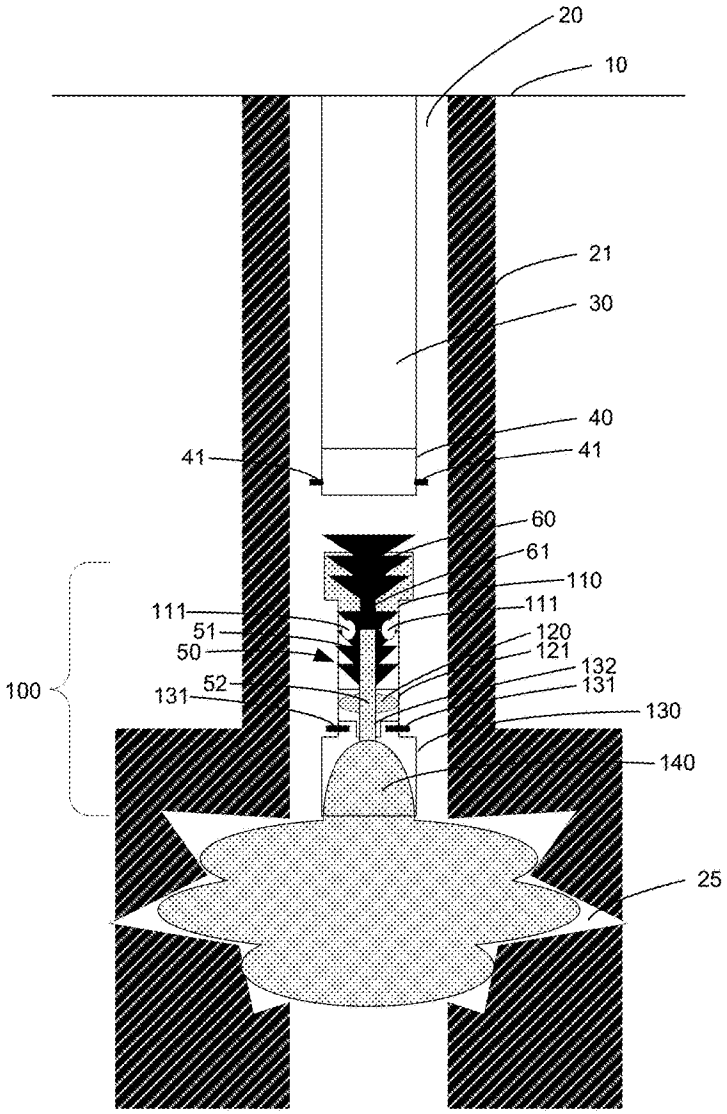
FIG. 6 is a cross-section of an example wellbore and an example system for curing a lost circulation zone as described in this specification with a string during retrieval.

Referring to FIG. 6, after SLCB holding pins 41 are sheared and a fluid seal is created uphole (proximal) to balloon 140, string 30 and releasing sub 40 may be retrieved and moved uphole. The slurry in the balloon 140, including the parts of the balloon 140 in the fractures of lost circulation zone 25, is set for a period of time to produce a solid (in the fracture) that can isolate the fracture from drilling fluid in the wellbore. As a result, fluid, for example, drilling fluid, may not escape into the fractures. Furthermore, the fractures may contain formation fluids, such as water or hydrocarbons. The solid within fractures confines the formation fluids within the fractures. As a result, the formation fluids do not mingle with drilling fluid or with cement slurry that may be introduced into the wellbore. Once fully hardened, a drill string including a drill bit (not shown) may be lowered into wellbore 20. The drill bit may cut through the SLCB tool 100, the solid, and the balloon 140 inside the wellbore, but leaves the solid and parts of the balloon 140 in the fractures. As a result, at least part of each fracture is filled with solid. As noted, drilling fluid cannot then escape into the fractures, and formation fluid cannot seep into the wellbore 20. The drill bit may then continue drilling to lower depths to complete the well.

The time needed for the slurry to set to produce a solid may vary based on a number of conditions including, but not limited to, the composition of the slurry, the temperature in the wellbore, and the pressure in the wellbore. In some implementations, the solid may have a hardness that is less than a complete hardness of cement. In some implementations, the solid may have a hardness that is at least as hard as a complete hardness of cement.

A curing a lost circulation zone as described in this specification may include additional or alternative components. In some implementations, a circulating sub may be positioned uphole (proximally) to SLCB tool 100. The circulating sub may be configured to displace drilling fluid prior to, or during, forcing slurry into a balloon 140. For example, the wellbore may contain drilling fluid prior to expansion of the balloon. The circulating sub may be operated to remove that drilling fluid. The circulating sub may continue its operation while slurry is pumped into the balloon 140. In some implementations, the circulating sub is configured to discontinue operation in response to the slurry reaching a circulating valve in the circulating sub. For example, at that point, the balloon may be expanded a desired amount. The operation of the circulating sub may be discontinued to allow the slurry in the inflatable to set. In some implementations, additional slurry may be pumped into the inflatable even after the circulating sub has discontinued operation.

Although vertical wellbores are show in the examples presented in this specification, the processes described previously may be implemented in wellbores that are, in whole or part, non-vertical. For example, the processes may be performed for a fracture that occurs in a horizontal, or partially horizontal, wellbore. where horizontal is measured relative to the Earth's surface in some examples.

Elements of different implementations described may be combined to form other implementations not specifically set forth previously. Elements may be left out of the processes described without adversely affecting their operation or the operation of the system in general. Furthermore, various separate elements may be combined into one or more individual elements to perform the functions described in this specification.

Other implementations not specifically described in this specification are also within the scope of the following claims.

What is claimed is:

1. A method for curing a wellbore, comprising identifying a lost circulation zone in a wellbore, the lost circulation zone comprising a fracture in a formation adjacent to the wellbore;

deploying a system in a vicinity of the lost circulation zone, the system comprising a stop lost-circulation balloon (SLCB) tool comprising an inflatable balloon, and comprising a tubing string comprising a fluid conduit, the string being in fluid connection with the balloon;

deploying a shut-off dart, the shut-off dart comprising a shut-off plug for sealing off one or more ports in a multiport sub and including a tube disposed within the shut-off dart establishing a fluid connection between an uphole end and a downhole end of the shut-off dart;

deploying, from the SLCB tool, the balloon;

forcing slurry into the balloon to cause at least part of the balloon containing the slurry into the fracture;

allowing the slurry to set for a period of time to produce a solid; and drilling through the solid in the balloon in the wellbore, leaving the solid in the fracture.

2. The method of claim 1, where the SLCB tool comprises a multiport sub, the multiport sub being in fluid communication with the string at an uphole end of the multiport sub and in fluid communication with the balloon at a downhole end of the multiport sub.

3. The method of claim 2, where the multiport sub comprises one or more ports in a wall of the multiport sub to allow wellbore fluid to enter the multiport sub.

4. The method of claim 1, where the SLCB tool comprises a balloon holder for at least partially housing and releasably retaining at least a part of the balloon.

5. The method of claim 1, where the SLCB tool comprises a flapper valve disposed between the multiport sub and the balloon to prevent wellbore fluids from entering the balloon when the flapper valve is shut.

6. The method of claim 1, where the SLCB tool is releasably connected at an uphole end of the SLCB tool to a release sub at a downhole end of the string.

7. The method of claim 1, where deploying the shut-off dart comprises causing a balloon holder to at least partially release the balloon from the holder, thereby deploying the balloon.

8. The method of claim 7, where the releasing the balloon comprises shearing, by the shut-off dart, one or more balloon holding pins.

9. The method of claim 1, where deploying the shut-off dart comprises sealing off the one or more ports in the multiport sub, opening a flapper valve disposed between the multiport sub and the balloon, and establishing a fluid connection between the fluid conduit of the string, the tube, and the balloon.

10. The method of claim 1, comprising deploying, after forcing slurry into the balloon, a releasing plug, where deploying the releasing plug causes the SLCB tool to be released from the string.

11. The method of claim 10, where the releasing the SLCB tool comprises shearing, by the releasing plug, one or more SLCB holding pins.

12. The method of claim 1, where, after forcing slurry into the balloon, the string is retraced uphole while the SLCB tool remains in position in the wellbore.

13. A system comprising:

a tubing string comprising a fluid conduit and a release sub, and a stop lost-circulation balloon (SLCB) tool releasably connected to the release sub, the SLCB tool comprising an inflatable balloon in fluid connection with the string;

a balloon holder at least partially housing and releasably retaining at least a part of the balloon;

a shut-off dart including a shut-off plug for sealing off one or more ports in a multiport sub and comprising a tube disposed within the shut-off dart establishing a fluid connection between an uphole end and a downhole end of the shut-off dart; and a multiport sub in fluid communication with the string at an uphole end of the multiport sub and in fluid communication with the balloon at a downhole end of the multiport sub.

14. The system of claim 13, comprising a flapper valve disposed between the multiport sub and the balloon to prevent wellbore fluids from entering the balloon when the flapper valve is shut.

15. The system of claim 13, where the multiport sub is connected to the releasing sub via one or more SLCB holding pins.

16. The system of claim 13, where the balloon is at least partially retained by the balloon holder via one or more balloon holding pins.

17. The system of claim 13, where the shut-off dart is configured to shear one or more balloon holding pins thereby releasing the balloon.

18. The system of claim 13, comprising a releasing plug for shearing one or more SLCB holding pins and releasing the SLCB tool from the string.

* * * * *